US010533797B2

(12) United States Patent
Sluka

(10) Patent No.: US 10,533,797 B2
(45) Date of Patent: Jan. 14, 2020

(54) DEVICE FOR CONTROLLING THE TEMPERATURE OF OBJECTS

(71) Applicant: Eisenmann SE, Boeblingen (DE)

(72) Inventor: Daniel Sluka, Waiblingen (DE)

(73) Assignee: EISENMANN SE, Böblingen (DE)

( * ) Notice: Subject to any disclaimer, the term of this patent is extended or adjusted under 35 U.S.C. 154(b) by 54 days.

(21) Appl. No.: 14/761,693

(22) PCT Filed: Jan. 4, 2014

(86) PCT No.: PCT/EP2014/000002
§ 371 (c)(1),
(2) Date: Jul. 17, 2015

(87) PCT Pub. No.: WO2014/111237
PCT Pub. Date: Jul. 24, 2014

(65) Prior Publication Data

US 2015/0354890 A1 Dec. 10, 2015

(30) Foreign Application Priority Data

Jan. 17, 2013 (DE) ..... 10 2013 000 754

(51) Int. Cl.
*F26B 3/04* (2006.01)
*F26B 21/02* (2006.01)
*F26B 21/00* (2006.01)

(52) U.S. Cl.
CPC ..... *F26B 3/04* (2013.01); *F26B 21/004* (2013.01); *F26B 21/02* (2013.01)

(58) Field of Classification Search
CPC .... F26B 3/04; F26B 3/28; F26B 3/283; F26B 3/00; F26B 3/02; F26B 3/14; F26B 21/00;
(Continued)

(56) References Cited

U.S. PATENT DOCUMENTS 4,908,231 A * 3/1990 Nelson ..... F26B 3/283 118/642
5,456,023 A * 10/1995 Farnan ..... F26B 9/06 34/270
(Continued)

FOREIGN PATENT DOCUMENTS

DE 20 2004 014 233 12/2004
EP 0 268 691 6/1988
(Continued)

*Primary Examiner* — Jessica Yuen
(74) *Attorney, Agent, or Firm* — Schroeder Intellectual Property Law Group, LLC

(57) ABSTRACT

The invention relates to a device for controlling the temperature of objects, in particular for drying coated vehicle bodies or body parts, the device having a housing and a temperature controlling tunnel accommodated into the housing. A temperature controlling device for controlling the temperature of the objects using a temperature-controlled gaseous fluid comprises fluid nozzles, through each of which a jet of fluid can be dispensed onto the objects. A tunnel atmosphere can be suctioned through at least one suction opening using a suction system, whereby a base current is generated in the direction of the at least one suction opening in the temperature controlling tunnel. A convection device is provided, by means of which a convection current can be generated in addition to the base current, said convection current supporting the base current.

14 Claims, 1 Drawing Sheet

(58) Field of Classification Search
CPC ..... F26B 21/02; F26B 21/04; F26B 21/004; F26B 2210/12
USPC ..... 34/270, 666
See application file for complete search history.

(56) References Cited

U.S. PATENT DOCUMENTS

| | | | |
|---|---|---|---|
| 6,062,850 | A | 5/2000 | Ino et al. |
| 2013/0232801 | A1 | 9/2013 | Wieland et al. |

FOREIGN PATENT DOCUMENTS

| | | | |
|---|---|---|---|
| EP | 1 302 737 | | 4/2003 |
| GB | 2 331 579 | | 5/1999 |
| JP | 2000197845 A | * | 7/2000 |

* cited by examiner

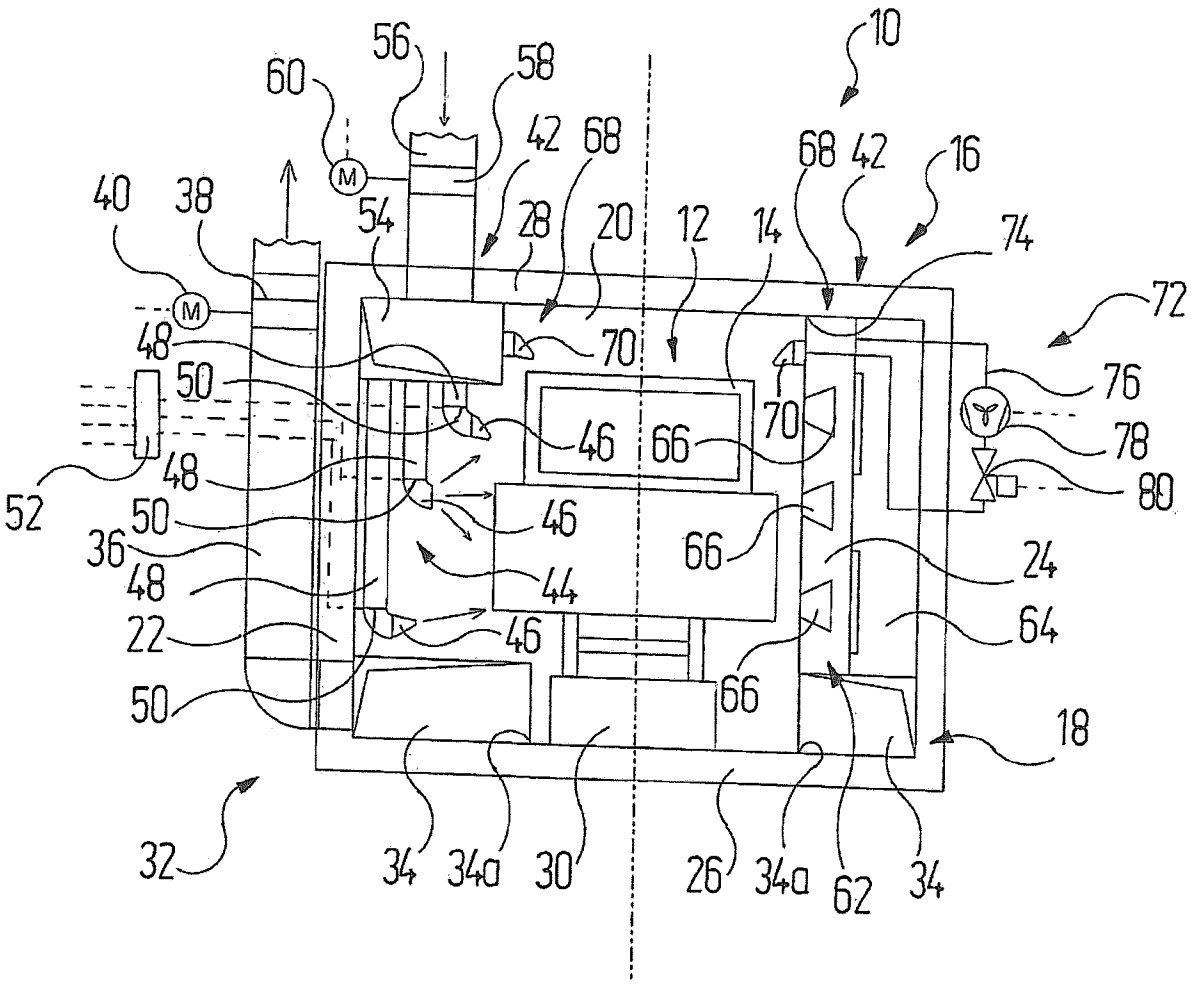
10
12
14
16
18
20
22
24
26
28
30
32
34
34a
36
38
40
42
44
46
48
50
52
54
56
58
60
62
64
66
68
70
72
74
76
78
80

DEVICE FOR CONTROLLING THE TEMPERATURE OF OBJECTS

RELATED APPLICATIONS

This application is a national phase of International Patent Application No. PCT/EP2014/000002, filed Jan. 4, 2014, which claims the filing benefit of German Patent Application No. 10 2013 000 754.2, filed Jan. 17, 2013, the contents of both of which are incorporated herein by reference.

FIELD OF THE INVENTION

The invention relates to a device for tempering objects, in particular for drying coated vehicle bodies or body parts, having a) a housing;

b) a tempering tunnel accommodated in the housing;

c) a tempering device for tempering the objects using a tempered gaseous fluid, which comprises fluid nozzles through which a jet of fluid can be discharged onto the objects in each case;

d) a suction system by means of which tunnel atmosphere can be suctioned through at least one suction opening, whereby a base current is generated in the direction of the at least one suction opening in the tempering tunnel.

BACKGROUND OF THE INVENTION

When talking of "tempering" an object and, concretely, a vehicle body here, this refers to bringing about a particular temperature of the object which it does not have initially. This can be an increase in temperature or a reduction in temperature. The term "tempered fluid" refers to a fluid which has the temperature required to temper the object.

An incidence of tempering, namely heating, vehicle bodies which is common in the automotive industry is the procedure of drying the coating of a vehicle body, which can refer, for example, to a paint or an adhesive or the like. The description below of the invention uses the example of such a dryer.

When talking of "drying" here, this refers to all procedures in which the coating of the vehicle body, in particular a paint, can be hardened, be this simply by expelling solvents or by cross-linking the coating substance.

Devices of the type mentioned at the outset, which are constructed as dryers, conventionally have a tempering device which is used to heat the vehicle body to a desired temperature. To this end, air nozzles apply tempered air evenly to the vehicle body from the side.

As a result of the base current, the heat carried by the air is conducted to the vehicle body and introduced there into the vehicle body. Effective temperature transfer of the hot air or, in general terms, the tempered fluid into the vehicle body—or, in the case of the cooling procedure, from the object into the fluid—requires good thermal convection via the air guided through the tempering tunnel.

In a dryer, air whereof the temperature is tempered to always be as high as possible is therefore conducted to the vehicle bodies and, to this end, a correspondingly high volume of air is guided through the tempering tunnel. However, this is relatively energy- and resource-consuming.

SUMMARY OF THE INVENTION

An object of the invention, therefore, is to provide a device of the type mentioned at the outset which ensures effective temperature transfer to the object with a good energy balance.

This object may be achieved in a device of the type mentioned at the outset by e) a convection device by means of which a convection current, which supports the base current, can be generated in addition to the base current.

The invention is based on the realisation that, by generating a type of support current, the thermal convection, i.e. the carrying and distribution of thermal energy, in tempered fluid is more effective. As a result of the convection current, a higher current velocity at the object is essentially achieved in the first instance so that the subsequent delivery of fresh tempered fluid can then take place more quickly, thereby resulting in effective heat movement into the object or out of the object.

To this end, it is particularly favourable if the convection device comprises one or more injector nozzles through which gaseous fluid can be blown into the tempering tunnel. A specifically directed jet of fluid can be generated by an injector nozzle.

It is advantageous if gaseous fluid can be blown into the tempering tunnel through the at least one injector nozzle with a directional component in the direction of the at least one suction opening. In this case, the convection current acts in the same direction as the base current.

The at least one injector nozzle is preferably arranged on a side of the tempering tunnel which is opposite the at least one suction opening. The convection current can therefore act over a large area of the tunnel cross-section.

Good results can be achieved if the at least one suction opening is arranged on the floor and the at least one injector nozzle is arranged in an upper region near to or on the ceiling of the tempering tunnel.

It is favourable if at least one injector nozzle is present whereof the mode of operation is such that the tempered gaseous fluid can be discharged by the injector nozzle. In this case, for example, the injector nozzle having the first mode of operation can be supplied with tempered fluid from the same source as the fluid nozzles.

Alternatively or additionally, at least one injector nozzle can be present whereof the mode of operation is such that circulated tunnel atmosphere can be discharged by the injector nozzle. In this case, the existing thermal energy of the tunnel atmosphere is used.

It is advantageous here if the at least one injector nozzle is connected to at least one outlet opening of the tempering tunnel by way of a circulating line and delivery means are present so that tunnel atmosphere can be delivered from the at least one outlet opening to the at least one injector nozzle.

An effective circulating current can be generated in the tempering tunnel if the at least one outlet opening is arranged radially adjacent to the injector nozzle in relation to a main axis of this latter.

It is favourable here if the outlet opening is arranged on a side of the injector nozzle which is remote from the discharge direction of the injector nozzle. This means that the discharge jet of the injector nozzle does not interfere with the circulating current in the tempering tunnel.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with reference to the single FIGURE.

This shows a vertical section of a dryer for drying coated vehicle bodies, with two variants of a tempering device being shown.

DETAILED DESCRIPTION OF THE PRESENT INVENTION

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

In the FIGURE, 10 denotes a device as a whole for tempering objects 12. Vehicle bodies 14 are shown to exemplify objects 12; the device 10, by way of example, is a dryer 16 for vehicle bodies 14. The dryer 16 comprises a housing 18 in which a tempering tunnel 20 is accommodated.

The tempering tunnel 20 is delimited laterally by two vertical longitudinal walls 22, 24, at the bottom by a floor 26 and at the top by a tunnel ceiling 28. The coated vehicle bodies 14 are conveyed through the tempering tunnel 20 by means of a transport system 30 which is shown-schematically. Provided at the end faces of the tempering tunnel 20 are locks (not shown generally) which enable the passage of the vehicle bodies 14 into the tempering tunnel 20 and out of this without extensive heat loss and with little atmospheric exchange.

When drying freshly painted vehicle bodies 14, predominantly solvents, but also coating constituents, are released into the air in the tempering tunnel 20. The tunnel atmosphere which is laden in this way is therefore suctioned downwards out of the tempering tunnel 20 by means of a suction system 32. The tunnel atmosphere is suctioned out of the tempering tunnel 20 by way of suction boxes 34 with a suction opening 34*a*, which are arranged on the floor 26 of the tempering tunnel and lead to an exhaust air channel 36. The flow cross-section of the exhaust air channel 36, and therefore the suction volume of the booth air, can be adjusted in a manner known per se by a pivotable flap 38 which can be pivoted with the aid of a motor 40.

A base current is generated in the tempering tunnel 20 in the direction of the suction openings 34*a* by the suction system 32. In the present exemplary embodiment, this base current runs substantially from top to bottom. If the suction openings 34*a* are arranged at another point, for example on the ceiling 28 of the tempering tunnel 20, the base current also runs correspondingly differently.

A tempering device 42 is arranged in the tempering tunnel 20. In FIG. 1, a respective variant of the tempering device 42 is shown on the left and right.

In the first variant, shown on the left in FIG. 1, the tempering device 42 comprises lateral nozzle arrangements 44 which flank the vehicle body 14 on both sides. The tempering device 42 moreover comprises, in a manner known per se, a plurality of floor nozzle arrangements (not shown specifically here) which are arranged so that the vehicle bodies 14 can move over these floor nozzle arrangements.

Each lateral nozzle arrangement 44 comprises a plurality of fluid nozzles 46 by means of which a jet of tempered fluid can be discharged onto the vehicle bodies 14. Previously heated air is used as the tempered fluid here, although other gases are also conceivable. In the present exemplary embodiment, the fluid nozzles 46 of the lateral nozzle arrangements 44 are activated and controlled independently of one another so that each of these fluid nozzles 46 is capable of discharging tempered air onto the vehicle body 14 independently of the other fluid nozzles 46 of the tempering device 42.

To this end, the fluid nozzles 46 of the lateral nozzle arrangements 44 are each supplied with tempered air via separate supply lines 48 in which a respective valve 50 is arranged, each of which can be controlled in isolation via a control means 52.

The supply lines 48 exit from a distribution channel 54 which extends on the ceiling 28 of the tempering tunnel 20 along its longitudinal walls 22 and is supplied by way of a supply channel 56 from outside the housing 18 with air from a source which is not shown specifically, which air has previously been tempered and conditioned in a manner known per se. The flow cross-section of the supply channel 56, and therefore the supply flow volume of the booth air, can be adjusted in a manner known per se by a pivotable flap 58 which can be pivoted with the aid of a motor 60.

The fluid nozzles 46 of the lateral nozzle arrangements 44 are positioned so that particularly extensive areas of the vehicle body 14 can be acted upon by tempered air. To this end, the fluid nozzles 46 in the present exemplary embodiment are associated from the bottom upwards with the sill region, a central region and an upper region of the vehicle body 14 near to the roof rails.

In the present exemplary embodiment, the fluid nozzles 46 are stationary and the discharge device is inalterable. In a modification, the fluid nozzles 46 of the lateral nozzle arrangements 44 can be pivoted in the horizontal plane so that the direction of a jet of fluid generated in each case by the fluid nozzles 46 is altered and adjusted and the jet of fluid can be carried along for example with a moving vehicle body 14. To this end, corresponding drives are present which likewise cooperate with the control means 52. A drive of this type can be an electric motor, but can also operate hydraulically or pneumatically. It is also optionally possible to dispense with the drives. In this case, the pivotal position of the fluid nozzles 46 can be adjusted for example manually.

The movement of the fluid nozzles 46 can also be executed in such a way that turbulence is generated in directed manner on the surface of the vehicle 14 body, thereby enabling the drying process to be accelerated. For example, the fluid nozzles 46 can be moved back and forth as they travel past the vehicle body 14.

In the second variant, shown on the right in FIG. 1, the tempering device 42 comprises lateral nozzle arrangements 62 which likewise flank the vehicle body 14 on both sides, but are designed differently from the lateral nozzle arrangements 44 of the first variant. In the second variant, the tempering device 42 also comprises the above-mentioned floor nozzle arrangements which are not shown specifically.

In the case of the lateral nozzle arrangements 62, the vertical longitudinal walls 22, 24 of the tempering tunnel 20 serve as an intermediate wall and separate the tempering tunnel 20 from two lateral pressure chambers 64 which now flank the tempering tunnel 20. The pressure chambers 64 and the tempering tunnel 20 are surrounded by the housing here 18.

In the two longitudinal walls 22, 24, there are a plurality of fluid nozzles 66 in each case, which produce a connection between the pressure chambers 64 and the tempering tunnel 20. In the present exemplary embodiment, the fluid nozzles 66 are stationary in their alignment.

However, in a modification which is not shown specifically, the fluid nozzles 66 can also be movably mounted so that their position, i.e. their angular position, and discharge direction can be adjusted. To this end, the fluid nozzles 66 can comprise, for example, a respective spherical segment with which they are seated in the longitudinal walls 22, 24 in a bearing opening which is complementary to them and has spherical delimiting walls. This then enables the fluid nozzles 66 to be pivoted in the bearing openings.

The pressure chambers 64 are supplied in known manner with tempered air which then flows through the fluid nozzles 66 and is discharged by these into the tempering tunnel 22 and conducted in the direction of the vehicle bodies 14.

Both lateral nozzle arrangements 44 or 62 can comprise short jet nozzles and wide jet nozzles. Short jet nozzles are nozzles with a short discharge range such that they can act on the side of the vehicle body 14 which faces them. Wide jet nozzles, on the other hand, have a larger discharge range than short jet nozzles, thereby enabling the hot air exiting the wide jet nozzles to be directed through an opening in the facing side face of the vehicle bodies 14, for example through a window opening or through an open door, onto the inside surface of the opposite vehicle-body side so that the air flow therefore passes through the entire interior of the vehicle body 14. The direction of this hot air here is such that it is predominantly directed onto the lower inner region of the vehicle body 14 where there is a relatively large mass and therefore a high thermal capacity.

Effective temperature transfer from the hot air into the vehicle body requires good thermal convection over the air guided through the tempering tunnel 20. So that the temperature of the air arriving on the vehicle bodies is always as high as possible, a correspondingly high volume of air has to be guided through the tempering tunnel 20.

To reduce the volumes of air required and the necessary resources as a whole, the tempering device 10 comprises a convection device 68 which aids in promoting a directed thermal convection in the tempering tunnel 20. This influences the distribution of the thermal energy in the air in the tempering tunnel 20 in such a way that the thermal energy carried by the tunnel atmosphere is introduced effectively into the vehicle bodies 14 and therefore used efficiently.

To this end, the convection device 68 comprises injector nozzles 70 which are arranged in an upper region near to or on the ceiling 28 of the tempering tunnel 20 and blow air into the tempering tunnel 20 with a directional component in the direction of the suction openings 34*a*.

In general, the injector nozzles 70 are arranged on a side of the tempering tunnel 20 which is opposite the suction openings 34*a*.

In a first exemplary embodiment of the convection device 68, injector nozzles 70 having a first mode of operation can be supplied with air from the same source as the tempering device 42. In the FIGURE, this is shown using the example of the first variant (shown on the left in FIG. 1) of the tempering device 42. In this, the injector nozzles 70 are supplied with air via the distribution channel 54.

In a modification which is not shown specifically, the injector nozzles 70 can also be supplied with air from a self-sufficient air source.

In a second exemplary embodiment of the convection device 68, injector nozzles 70 having a second mode of operation are present, from which circulated tunnel atmosphere can be discharged. Injector nozzles 70 having the second mode of operation are components of a circulating device 72 which is illustrated in the second variant of the tempering device shown on the right in the FIGURE. In this, outlet openings 74 are located in the upper region of the tempering tunnel 20 and are connected to one or more of the injector nozzles 70 by way of a circulating lines 76. The outlet openings 74 here are arranged at a high level above the injector nozzles 70.

In the present case, the outlet openings 74 are arranged radially adjacent to the injector nozzle 70 relative to a main axis of this latter, which is not shown specifically. However, the outlet openings 74 can essentially also be positioned at another point in the tempering tunnel 20.

A fan 78 and a valve 80, which are both controlled by the control means 52, are located as delivery means in each circulating line 76. When the fan 78 is active and the valve 80 open, tunnel atmosphere above the injector nozzles 70 is therefore suctioned off, guided to the injector nozzles 70 and discharged downwards through these into the tempering tunnel 20.

A convection current supporting the base current is generated in addition to the base current by the convection device 68, irrespective of its mode of operation. In the present exemplary embodiment, this passes along the outside of the vehicle bodies 14 so that cooled air, whereof the thermal energy has already been introduced into the vehicle body 14, is rapidly transported away and can be replaced by a subsequent current of hotter air.

The convection device 68 can generate a stronger current in the tempering tunnel 20 with less air than is possible without the convection device 68 and in particular without the injector nozzles 70.

In the case of the circulating device 72, a cyclic current relative to the tunnel cross-section is produced in the tempering tunnel 20 and passes via the injector nozzles 70 along the outer flanks of the vehicle bodies 14 to the floor 26 of the tempering tunnel 20, there to its centre and from there upwards to the ceiling 28 of the tempering tunnel 20, where the air is then suctioned off to the side via the outlet openings 74. If two circulating devices 72 are present on both sides of the tempering tunnel 20, two such cyclic currents are produced accordingly.

These cyclic currents are produced in particular in that the outlet openings 74 are arranged above the injector nozzles 70 or, in general terms, on a side of the injector nozzle 70 which is remote from the discharge direction of the injector nozzle 70.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A device for tempering objects comprising:

a) a housing;

b) a tempering tunnel accommodated in the housing;

c) a tempering device for tempering objects using a tempered gaseous fluid, which comprises fluid nozzles through which a jet of fluid can be discharged into the tempering tunnel and onto objects in a first direction with a first directional component;

d) a suction system by means of which tunnel atmosphere can be suctioned through at least one suction opening, whereby a base current running from a top portion of the tempering tunnel to the bottom portion of the tempering tunnel is generated in the tempering tunnel in the direction of the at least one suction opening, wherein e) a convection device generating a convection current, which supports the base current, the convection device providing the convection current through one or more injector nozzles blowing gaseous fluid into the tempering tunnel towards the object in a second direction towards the at least one suction opening, the second direction having a second directional component which will intersect to the first directional component, the convection device being operable in two modes of operation, wherein in a first mode of operation the tempered gaseous fluid is supplied to and discharged by the one or more injector nozzles, and in a second mode of operation, tunnel atmosphere is supplied to the one or more injector nozzles and discharged by the one or more injector nozzles back into the tunnel.

2. The device according to claim 1, wherein gaseous fluid can be blown into the tempering tunnel through the one or more injector nozzles with a directional component in the direction of the at least one suction opening.

3. The device according to claim 1, wherein one or more injector nozzles are arranged on a side of the tempering tunnel which is opposite the at least one suction opening.

4. The device according to claim 3, wherein the at least one suction opening is arranged on the floor and the one or more injector nozzles are arranged in an upper region adjacent or on the ceiling of the tempering tunnel.

5. The device according to claim 1, wherein the one or more injector nozzles are connected to at least one outlet opening of the tempering tunnel by way of a circulating line and delivery means are present so that tunnel atmosphere can be delivered from the at least one outlet opening to the one or more injector nozzles.

6. The device according to claim 5, wherein the at least one outlet opening is arranged radially adjacent to the one or more injector nozzles relative to a main axis of the latter.

7. The device according to claim 5, wherein the at least one outlet opening is arranged on a side of the one or more injector nozzles which is opposite the discharge direction of the injector nozzle.

8. The device according to claim 1, wherein the second directional component that is transverse to the first directional component.

9. The device according to claim 1, wherein the fluid nozzles comprise at least two separate fluid nozzles, each of the two fluid nozzles being activatable and controllable independent of the other fluid nozzle.

10. The device according to claim 1, wherein the fluid nozzles and the one or more injector nozzles are positioned within the tempering tunnel.

11. The device according to claim 10, wherein the one or more injector nozzles are positioned within the tempering tunnel opposite the at least one suction opening.

12. The device according to claim 11, wherein the second direction has a directional component towards the at least one suction opening.

13. A device for tempering objects comprising:

a) a housing;

b) a tempering tunnel accommodated in the housing;

c) a tempering device comprising a plurality of fluid nozzles through which a jet of fluid can be discharged into the tempering tunnel in a first direction;

d) a suction system by means of which tunnel atmosphere can be suctioned through at least one suction opening formed in a floor of the tempering tunnel, whereby a base current is generated in the tempering tunnel in the direction of the at least one suction opening, e) a convection device comprising at least one injector nozzle located in an upper region adjacent or on the ceiling of the tempering tunnel, the at least one injector nozzle blowing gaseous fluid into the tempering tunnel towards the at least one suction opening in a second direction, the second direction intersecting the first direction, f) at least one outlet opening, the at least one outlet opening being positioned radially adjacent the at least one injector nozzle, the at least one outlet opening being coupled to the at least one injector nozzle by a circulating line, wherein in a first mode of operation the tempered gaseous fluid is supplied to and discharged by the at least one injector nozzle, and in a second mode of operation, tunnel atmosphere exiting the tunnel through the at least one outlet opening is supplied to the at least one injector nozzle through the circulating line and discharged by the at least one injector nozzle back into the tunnel.

14. The device of claim 13, wherein the at least one outlet opening is arranged on a side of the at least one injector nozzle which is opposite the discharge direction of the injector nozzle.

* * * * *